US007434711B1

(12) United States Patent
Sutton

(10) Patent No.: US 7,434,711 B1
(45) Date of Patent: Oct. 14, 2008

(54) GARMENT HANGER WITH PIVOTING JAW ENDS

(75) Inventor: Steven Sutton, Brooklyn, NY (US)

(73) Assignee: The Accessory Corp., New York, NY (US)

( * ) Notice: Subject to any disclaimer, the term of this patent is extended or adjusted under 35 U.S.C. 154(b) by 190 days.

(21) Appl. No.: 11/189,214

(22) Filed: Jul. 26, 2005

(51) Int. Cl.
*A41D 27/22* (2006.01)

(52) U.S. Cl. ..... 223/96; 223/85; 223/95; 223/DIG. 2; 248/316.5

(58) Field of Classification Search ..... 223/85, 223/88, 90, 91, 93, 95, 96, DIG. 2; 24/30.5 R, 24/499, 500, 501, 504, 508, 511, 346, 489, 24/DIG. 22, 507, 556, 571; 248/316.3, 316.4, 248/316.5, 316.6
See application file for complete search history.

(56) References Cited

U.S. PATENT DOCUMENTS

| | | | | | |
|---|---|---|---|---|---|
| 1,404,436 | A * | 1/1922 | Giroux | 452/187 |
| 2,401,413 | A * | 6/1946 | Colwell | 223/96 |
| 2,435,859 | A * | 2/1948 | Whitman | 223/91 |
| 2,483,303 | A * | 9/1949 | Rysick | 223/96 |
| 2,488,709 | A * | 11/1949 | Colwell | 24/498 |
| 2,524,537 | A * | 10/1950 | Osmonson | 223/90 |
| 2,898,024 | A * | 8/1959 | Jenson | 223/91 |
| 3,464,605 | A * | 9/1969 | Ormond | 223/96 |
| 3,779,108 | A | 12/1973 | Reiter | |
| 4,009,807 | A | 3/1977 | Coon | |
| 4,763,390 | A * | 8/1988 | Rooz | 24/487 |
| 5,632,423 | A * | 5/1997 | Louw | 223/91 |
| 5,791,210 | A | 8/1998 | Wolff et al. | |
| 5,810,217 | A * | 9/1998 | Ohsugi | 223/85 |
| 6,101,689 | A * | 8/2000 | Jo | 24/338 |
| 6,250,523 | B1 * | 6/2001 | Louw | 223/96 |
| 6,609,641 | B2 | 8/2003 | Sutton | |
| 6,612,000 | B2 * | 9/2003 | Housley | 24/510 |
| 6,622,897 | B2 * | 9/2003 | Bokmiller et al. | 223/93 |
| 6,860,179 | B2 | 3/2005 | Hopper et al. | |
| 6,863,197 | B1 * | 3/2005 | Dirlam et al. | 223/93 |
| 6,923,350 | B2 * | 8/2005 | Gouldson et al. | 223/96 |
| 7,140,585 | B2 * | 11/2006 | Wakuta | 248/306 |
| 7,150,381 | B2 * | 12/2006 | Goldman | 223/91 |
| 2002/0158091 | A1 * | 10/2002 | Matkovich | 223/93 |
| 2003/0126725 | A1 * | 7/2003 | Housley | 24/510 |
| 2003/0209577 | A1 * | 11/2003 | Gouldson et al. | 223/85 |
| 2005/0067447 | A1 * | 3/2005 | Louw | 223/96 |

OTHER PUBLICATIONS

Helping Hand "MicroClamp" product description sheet from www.faucetqueen.com/catalog.asp?Search+Micro+Clamp.

* cited by examiner

*Primary Examiner*—Gary L. Welch
*Assistant Examiner*—Nathan E Durham
(74) *Attorney, Agent, or Firm*—Gordon & Jacobson, PC

(57) ABSTRACT

A garment hanger according to the invention is provided with at least one clamp comprised of a pair of jaw members. At least one of the jaw members has a pivoting jaw end.

25 Claims, 6 Drawing Sheets

GARMENT HANGER WITH PIVOTING JAW ENDS

This application is related to co-owned U.S. Pat. Nos. 6,609,641; 6,474,517; 6,199,728 and 6,173,872, the complete disclosures of which are hereby incorporated by reference herein.

BACKGROUND OF THE INVENTION

1. Field of the Invention

This invention relates broadly to garment hangers. More particularly, this invention relates to a garment hanger having a pivoting jaw end.

2. State of the Art

Clamp-type garment hangers having at least one clamp are well-known for the suspension or hanging of garments such as pants, skirts, etc. The "pinch-type" clamp is a variety of clamp that has a clamp end having a pair of opposed clamp or jaw members between which a portion of the garment is secured, and a handle portion having a pair of spaced apart handles. Provision is made for biasing the jaw members towards each other to create the clamping force necessary to retain a garment between inner surfaces of the jaw members. The jaw end of the clamp is hinged to the handle portion such that squeezing or pinching the handles toward one another, i.e., to reduce the space between the handles, causes the jaw members to open to receive or release a garment. To further retain the garment between the inner surfaces of the members, the clamp or jaw members typically also include inner surfaces gripping elements or friction increasing surfaces.

An example of a pinch-type clamp hanger is shown in U.S. Pat. No. 5,398,854 to Blanchard, which describes a hanger with a clamp having a jaw end, a handle portion at an opposite end from the jaw end, and a hinge point between the two ends. The jaw ends are provided with resilient friction pads to engage a garment provided in the clamp. A C-shaped spring clip provides the means for biasing the jaws to a closed position. Another exemplar pinch-type clamp hanger is shown in U.S. Pat. No. 4,395,799 to Batts. This clamp hanger has two sets of toothed elements on the inside of one of the jaws, which surround a single toothed element on the other of the jaws to secure a garment in the clamp of the hanger.

Co-owned U.S. Pat. Nos. 6,474,517 and 6,609,641 disclose a garment hanger having jaw members that are provided with an arrangement of ridges, at least some of the ridges defining a plurality of teeth. The ridges are preferably arranged in three rows in each of the jaw members, and each row preferably extends substantially across the respective jaw member. Each of the ridges preferably has a rear wall which extends substantially perpendicular to the surface on which the ridges are located, and a front wall which extends from the surface on which the ridges are located to the rear wall such that each of the ridges in cross-section has a cuspid-like appearance. The clamp has been demonstrated to have superior gripping ability on denim jeans garments.

Clamp-type garment hangers which utilize teeth, often sharp or otherwise pointed, suffer from the drawback of introducing unwanted creases, marks, holes, projections or disfigurations to more delicate garment. Where the garment is especially delicate, these hangers can be particularly harmful to the garment.

Co-owned U.S. Pat. Nos. 6,173,872 and 6,199,728 disclose a clamp-type hanger wherein the opposed jaw members have gripping members and opposed gripping surfaces. The gripping members, opposed gripping surfaces and jaw members of one jaw member are formed from the same material, which may include either polystyrene, polypropylene, polyethylene, styrene-butadiene copolymers and blends, polycarbonates, TPR/TPE, TPU, and various thermoplastics. The other jaw member has bonded thereto an elastomer material for gripping the garment. To increase the coefficient of friction of the opposed gripping surfaces, the mold which is used to form the gripping surfaces may be treated by engraving, acid etching, electrical discharge machining, vapor honing, or sandblasting. The jaws on this hanger do not crease or damage delicate garments. However, they do not do as well in holding rugged garments such as jeans which are held better by jaws that have teeth.

SUMMARY OF THE INVENTION

It is therefore an object of the invention to provide a garment hanger which is adaptable to hold either delicate garments or rugged garments.

In accord with these objects, which will be discussed in detail below, a garment hanger according to the invention is provided with at least one clamp comprised of a pair of jaw members. At least one of the jaw members has a pivoting jaw end. Preferably, the pivoting jaw end pivots sufficiently so that it can selectively exhibit two different gripping surfaces. In one embodiment, one of the gripping surfaces is designed for rugged garments and the other is designed for delicate garments. The gripping surfaces are selectable by rotating the jaw end to one of two positions. Preferably, a locking arrangement is provided to secure the jaw end in the selected position. As used herein, "locking" means resisting rotation but not preventing rotation.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
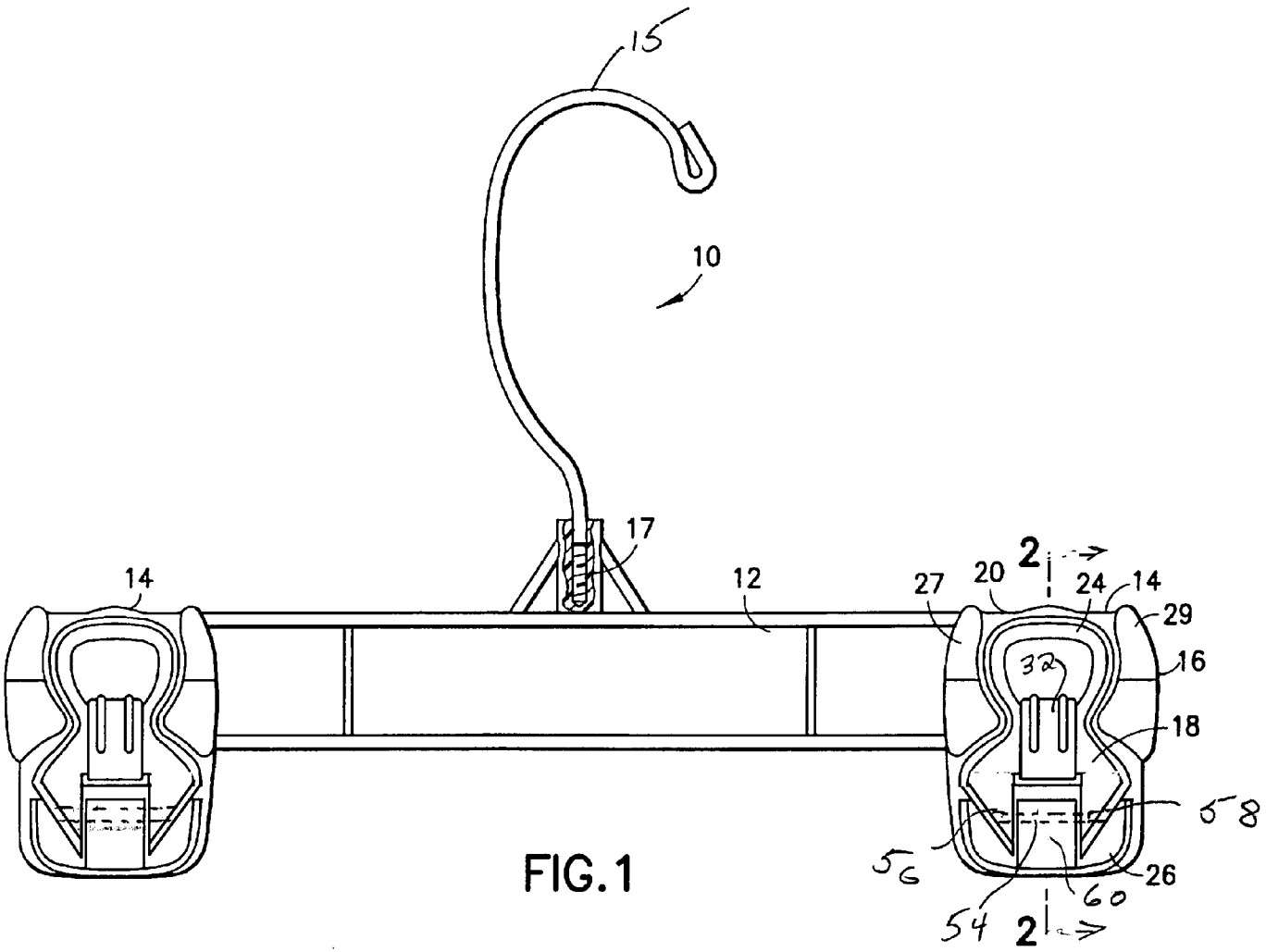
FIG. 1 is a front view of a garment hanger having a clamp according to the invention at each end of a hanger body.

Referring now to FIG. 1, a garment hanger 10 includes a hanger body 12 having at each end a pinch-type clamp 14. Garment hanger 10 includes a hook member 15, which may be formed from plastic or metal wire or any other appropriate material. The partial loop or hook member may be secured via threads 17 to the body 12, as shown, or may be integrally formed from the same material as body 12, or may be connected to the body in any other manner. The body 12 is preferably made from any number of well known plastic or resin materials, such as "k"-resin, polystyrene, polypropylene, polyethylene, styrene-butadiene copolymers and blends, polycarbonates, thermoplastics and combinations thereof.

Figure 2:
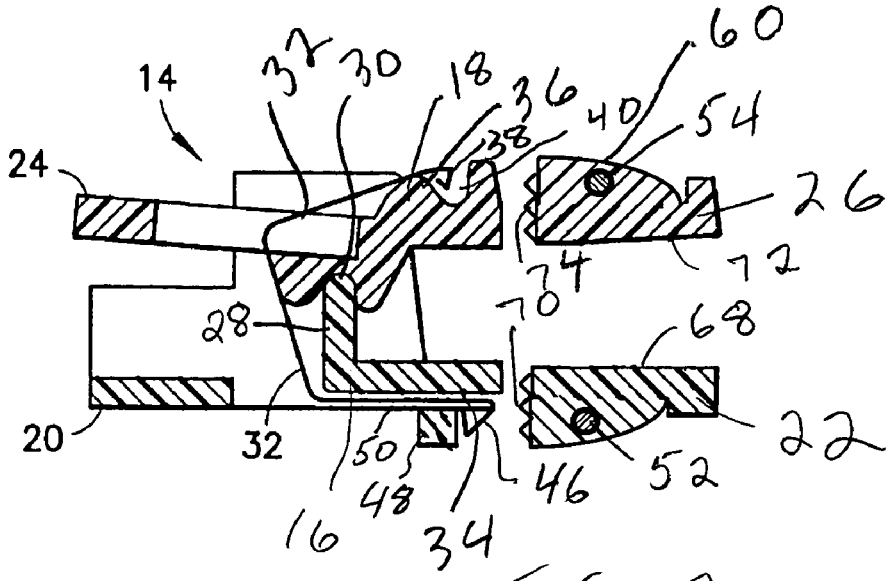
FIG. 2 is a sectional view taken along line 2-2 in FIG. 1 with the clamp opened and the jaw ends rotated to the position for delicate garments.

Referring now to FIGS. 1 and 2, the clamps 14 are preferably formed from the same material as the body 12. Each clamp 14 has a back base member 16 which is preferably integrally formed with the body, and a front lever member 18 movable relative thereto. The base member 16 includes a handle portion 20 and a jaw end 22, and the lever member 18 includes a handle portion 24 which is opposite handle portion 20, and a jaw end 26 which is positioned opposite jaw end 22. The lever member 18 is pivotally supported on the base member 16 along a pivot wall 28 extending between two supports 27, 29 on the base member 16. The pivot wall 28 is received in a pivot groove 30 on the back of lever member 18. A C-shaped spring clip 32, preferably made of metal but alternatively made of plastic, is dimensioned to receive a portion of the base member 16 and a portion of the lever member 18 and is positioned over those portions such that facing inner surfaces of the spring clip 32 bear against outwardly facing surfaces 34, 36 of the base member 16 and the lever member 18, respectively. A front end of the spring clip 32 has a flange 38 that engages within an aperture 40 in the lever member 18 to secure the spring clip 32 to the lever member. A rear end of the spring clip 32 has a tab 46 which engages a strut 48 spanning an aperture 50 in the base member 16 to secure the spring clip to the base member. The spring clip 32 urges the lever member jaw end 26 towards the base member jaw end 22.

Figure 3:
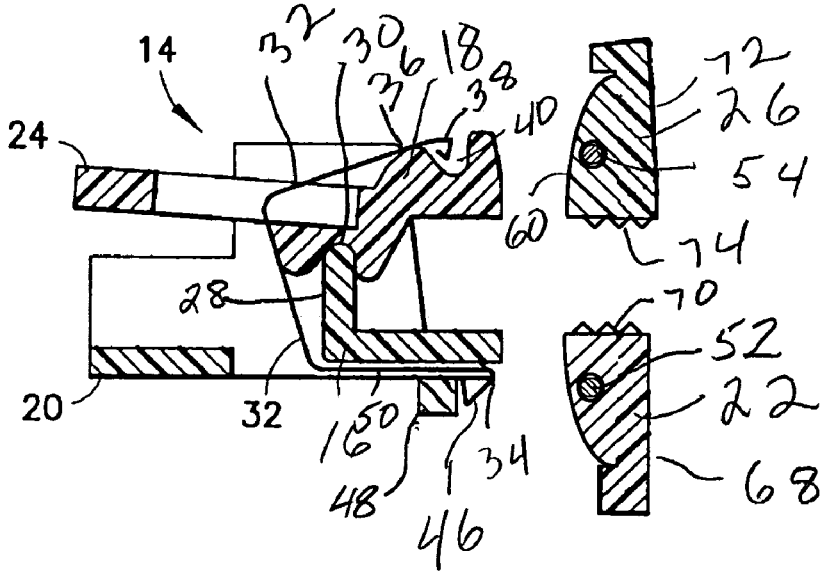
FIG. 3 is a view similar to FIG. 2 but with the jaw ends rotated to the position for rugged garments.
Figure 4:
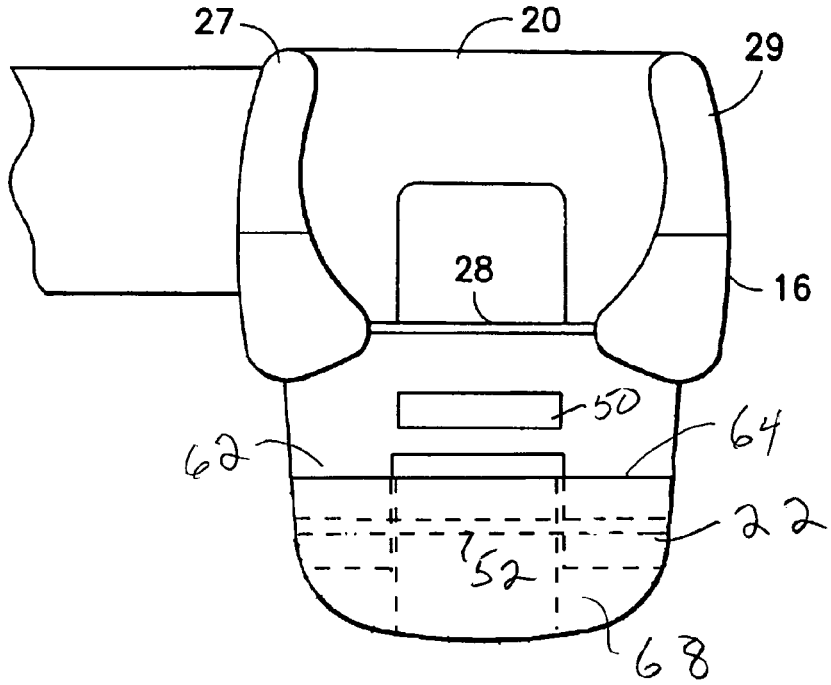
FIG. 4 is a broken front view of a portion of the hanger with one of the jaw members removed and the remaining jaw end rotated to the position for delicate garments.

According to a first aspect of the invention, the jaw ends 22, 26 are pivotally mounted on axles 52, 54 so that they may be rotated from the position shown in FIG. 2 to the position shown in FIG. 3 or from the position shown in FIG. 3 to the position shown in FIG. 2. More particularly, as shown in FIG. 1, the lower portion of the lever member 18 is bifurcated thereby presenting two arms 56, 58. The jaw end 26 is provided with a tongue 60 which lies between the arms 56, 58 and is pivotally joined to them by axle 54. Similarly as seen best in FIGS. 4 and 5, the lower portion of the base member 16 is bifurcated thereby presenting two arms 62, 64. The jaw end 22 is provided with a tongue 66 which lies between the arms 62, 64 and is pivotally joined to them by axle 52.

According to a second aspect of the invention, the rotatable jaw ends 22, 26 are each provided with two different kinds of gripping surfaces 68, 70, 72, 74. According to the presently preferred embodiment, the surfaces 68 and 72 are designed for delicate garments and may be fabricated according to the teachings of previously incorporated co-owned U.S. Pat. Nos. 6,173,872 and 6,199,728. The gripping surfaces 70 and 74, on the other hand, are preferably designed to grip rugged garments and may be fabricated according to the teachings of previously incorporated co-owned U.S. Pat. Nos. 6,474,517 and 6,609,641.

Figure 6:
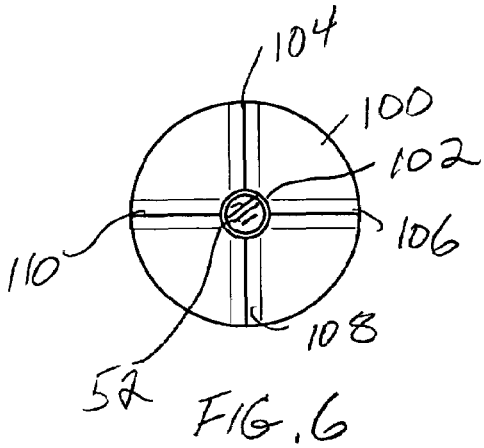
FIG. 6 is a schematic plan view of a male locking member.
Figure 7:
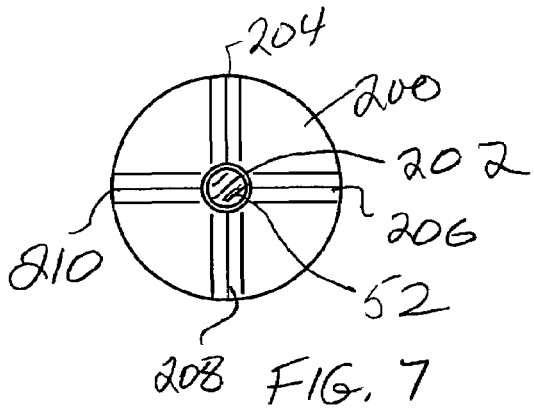
FIG. 7 is a schematic plan view of a female locking member.
Figure 8:
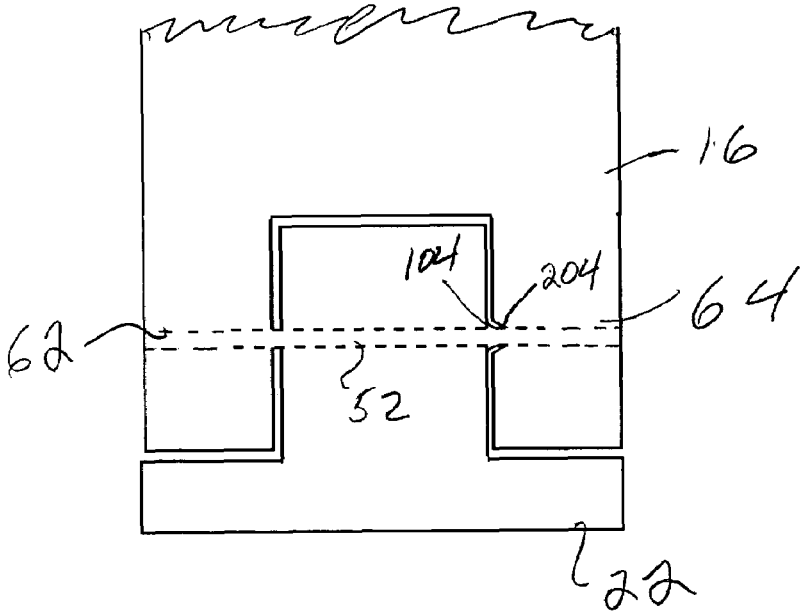
FIG. 8 is a view similar to FIG. 5 (but broken) schematically illustrating the male and female locking members in a locked position.

According to a third aspect of the invention, locking means are provided to hold the jaw ends in each of the selected positions. As seen in FIGS. 2 and 3, the two positions are rotationally ninety degrees apart. FIGS. 6-8 schematically illustrate an exemplary locking structure for locking a rotational member in two positions which are ninety degrees apart. FIG. 6 shows a first locking surface 100 surrounding an axle hole 102 through which axle 52 extends. Four bumps 104, 106, 108, 110 are arranged radially relative to the axle hole 102 and spaced apart from each other by ninety degrees. FIG. 7 shows a second locking surface 200 surrounding an axle hole 202 through which axle 52 extends. Four valleys 204, 206, 208, 210 are arranged radially relative to the axle hole 202 and spaced apart from each other by ninety degrees. FIG. 8 illustrates how the bumps and the valleys provided on jaw end 22 and arm 64 of base member 16 interact to provide resistance to rotation. Although FIGS. 6 and 7 show four bumps and four valleys, it will be appreciated that the locking mechanism only needs one bump and two valleys. It will also be appreciated that, as shown in FIG. 8, the jaw end need only be provided with one locking surface and that only the arm adjacent to the locking surface of the jaw end need be provided with a mating locking surface. If desired, however, locking surfaces could be provided in two locations on the jaw end and on both arms 62, 64. Though not illustrated, it will be appreciated that a similar locking arrangement could be provided for both jaw ends 22 and 26. Preferably, the valleys should be larger than the bumps so that the jaw ends are free to self-position.

Figure 5:
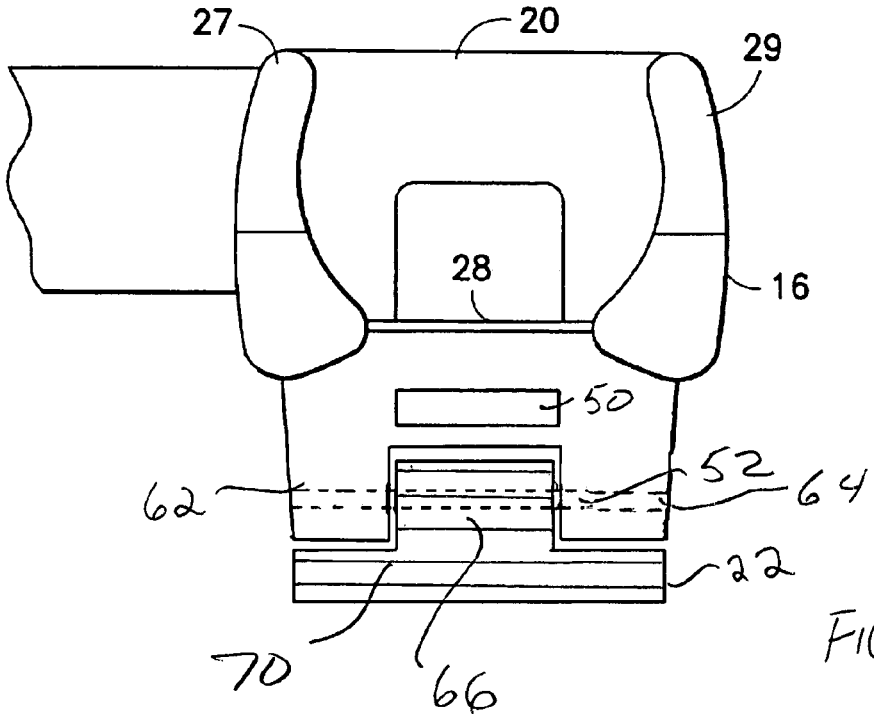
FIG. 5 is a view similar to FIG. 4 but with the jaw ends rotated to the position for rugged garments.
Figure 9:
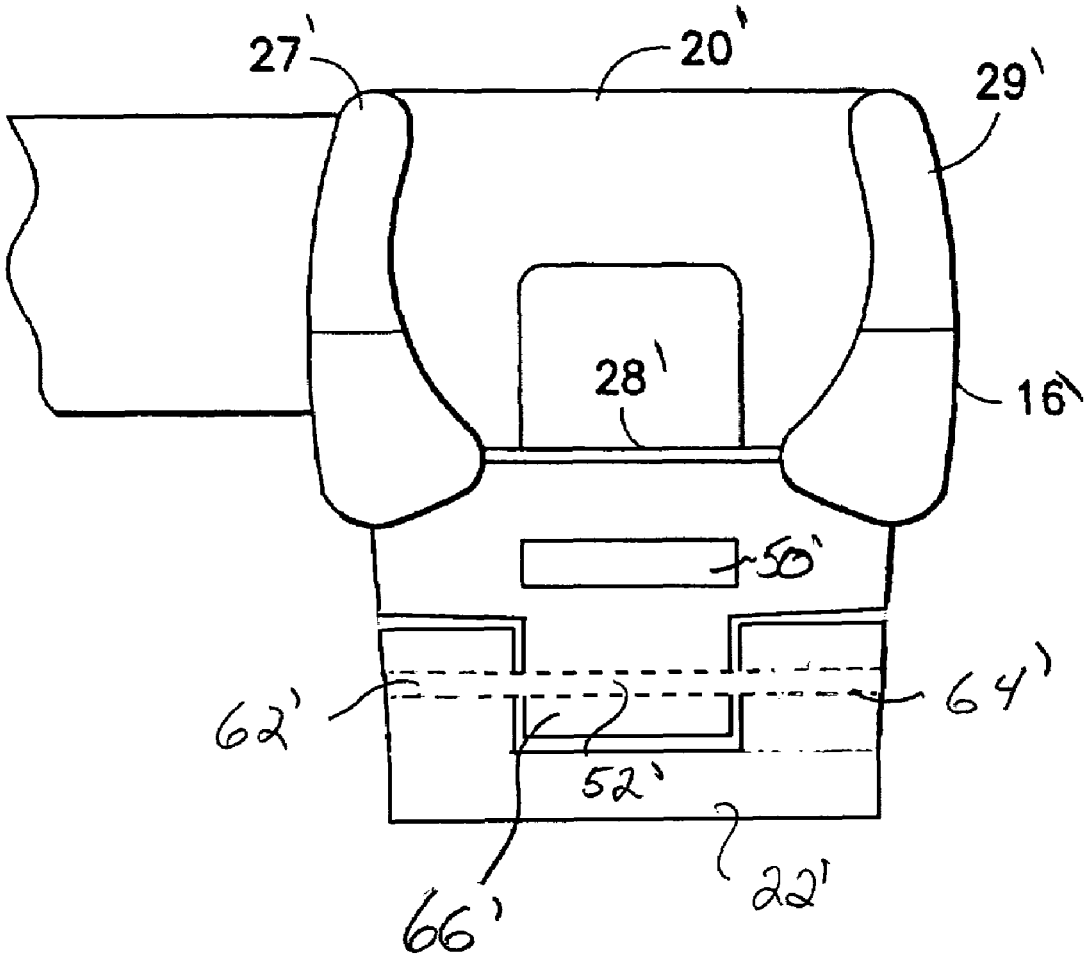
FIG. 9 is a view similar to FIG. 5 but illustrating an alternate manner of mounting the pivoting jaw ends.

FIG. 9 is a view similar to FIG. 5 with similar reference numerals referring to similar parts. In the embodiment of FIG. 9, the jaw end 22' is bifurcated to present two arms 62', 64'. The lower portion of the base member 16' is provided with a central finger or tongue 66' which extends between the arms 62', 64' and is pivotally coupled to them by the axle 52'. A similar arrangement can be provided for the lever member 18 and the jaw end 26. As in the previously described embodiment, the jaw ends present different surfaces depending on the position into which they are pivoted.

Figure 10:
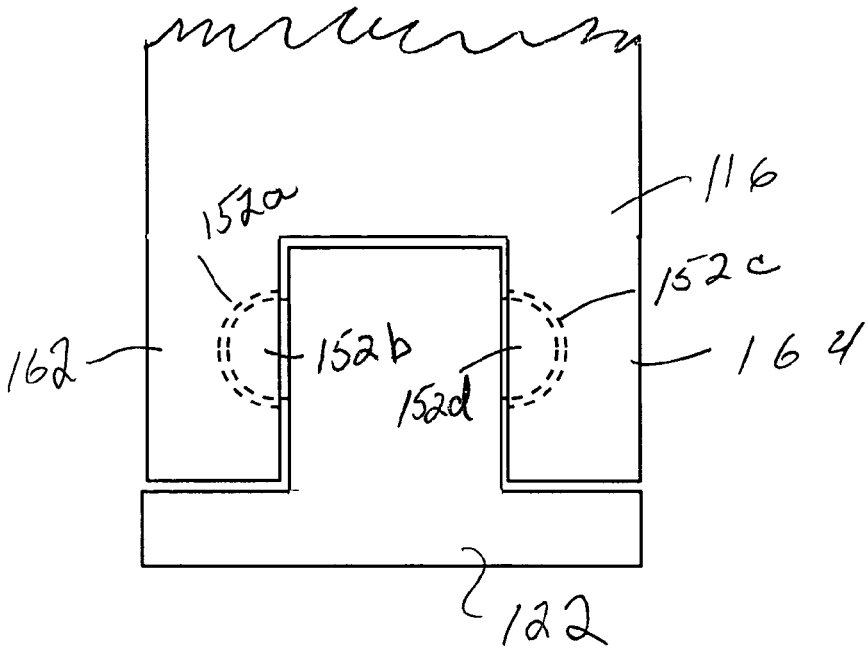
FIG. 10 is a view similar to FIG. 8 illustrating a first alternative to axle mounting.

FIG. 10 illustrates another embodiment of the invention which does not utilize an axle. In this embodiment, the jaw end 122 is pivotally coupled to the base member 116 via recesses 152*a*, 152*c* in arms 162, 164, respectively, which receive bumps 152*b*, 152*d* on the tongue of the jaw end 122. Though only illustrated with respect to one jaw end, it will be appreciated that the other jaw end could be coupled in the same way. It will further be appreciated that the jaw ends mounted in this manner will present different selectable gripping surfaces and can be provided with the same kind of locking mechanism as described above with reference to FIGS. 6-8.

Figure 11:
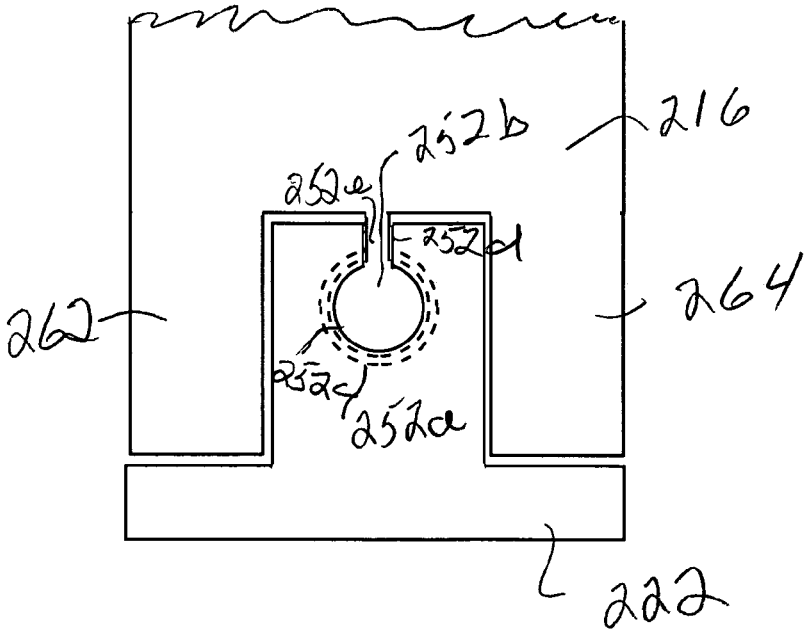
FIG. 11 is a view similar to FIG. 8 illustrating a second alternative to axle mounting.

FIG. 11 illustrates another embodiment of the invention which does not utilize an axle. In this embodiment, the jaw end 222 includes a spherical socket 252*a* and the base member 216 includes a ball 252*b* which engages the socket. The socket 252*a* includes an access hole 252*c* which has a diameter slightly smaller than the diameter of the ball 252*b* (i.e. large enough to allow the ball to be force fit into the socket but small enough to secure the ball in the socket). A slot 252*d* extends radially outward from the socket and intersects the hole 252*c*. The ball 252*b* has a stem 252*e* which couples the ball to the base member 216. The stem 252*e* passes through the slot 252*d* allowing the jaw end 222 to rotate ninety degrees relative to the base member 216. Though only illustrated with respect to one jaw end, it will be appreciated that the other jaw end could be coupled in the same way. It will further be appreciated that the jaw ends mounted in this manner will present different selectable gripping surfaces and can be provided with the same kind of locking mechanism as described above with reference to FIGS. 6-8.

There have been described and illustrated herein several embodiments of a garment hanger with pivoting jaw ends. While particular embodiments of the invention have been described, it is not intended that the invention be limited thereto, as it is intended that the invention be as broad in scope as the art will allow and that the specification be read likewise. Thus, while particular rotational structures involving arms, a tongue, an axle, ball and socket, etc. have been disclosed, it will be appreciated that other rotational structure may be used as well. In addition, while particular types of gripping surfaces have been disclosed, it will be understood that other gripping surfaces can be used. Also, while the jaws and jaw ends are described as preferably being made from the same material as the hanger, it will be appreciated that the jaws and/or jaw ends can be made from different materials than the remainder of the hanger. In fact, in some cases it may be desirable for the jaw ends to be made from a plurality of materials which present different selectable surface features (different roughnesses, hardnesses, resiliencies, etc.) It will also be appreciated that while the jaw assembly has been shown to be of the type having a lever, other configurations could be used as well, including the type wherein a biasing spring is lifted up to open the jaws and pressed down to close the jaws. Furthermore, although the hanger has been illustrated as having a hook, other well known hanging means (e.g., a full loop) could be used in appropriate situations. While the invention has been described with each clamp having two pivoting jaw members, it will be appreciated that it is possible to provide a single pivoting jaw member mated with a stationary jaw member and still achieve some of the benefits of the invention. Also, while the jaw ends have been shown with two selectable gripping surfaces, more or fewer gripping surfaces may be provided. If only one gripping surface is provided, the pivoting action of the jaw ends serves to self-position better conforming to the garment. It will therefore be appreciated by those skilled in the art that yet other modifications could be made to the provided invention without deviating from its spirit and scope as claimed.

What is claimed is:

1. A garment hanger, comprising:

a hanger body;

a hanging structure extending up from said body; and a first clamp extending down from said body, said first clamp having first and second jaw members, one of said first and second jaw members being pivotable relative to the other of said first and second jaw members, each of said first and second jaw members having a jaw end, one of said first and second jaw members having a jaw end which is pivotable relative to said one of said first and second jaw members, wherein said jaw end which is pivotable exhibits two independently selectable gripping surfaces, one of said gripping surfaces being relatively smooth and the other of said gripping surfaces being relatively rough.

2. A garment hanger according to claim 1, further comprising:

a locking structure for locking said jaw end which is pivotable in two positions, each position selecting one of said two selectable gripping surfaces.

3. A garment hanger according to claim 1, further comprising:

a second clamp extending down from said body, said second clamp having third and fourth jaw members, each having a jaw end, one of said third and fourth jaw members having a jaw end which is pivotable relative to said one of said third and fourth jaw members, said jaw end which is pivotable exhibiting two selectable gripping surfaces.

4. A garment hanger according to claim 3, wherein said jaw ends which are pivotable each exhibit one gripping surface which is relatively smooth and another gripping surface which is relatively rough.

5. A garment hanger according to claim 4, further comprising:

two locking structures, one for locking each of said jaw ends which are pivotable in two positions, each position selecting one of said two selectable gripping surfaces.

6. A garment hanger according to claim 5, wherein:

said locking structures include a bump and two valleys.

7. A garment hanger according to claim 4, wherein:

said relatively rough gripping surface comprises a plurality of teeth.

8. A garment hanger according to claim 7, wherein:

said relatively smooth gripping surface is textured.

9. A garment hanger according to claim 4, wherein:

said relatively smooth gripping surface is textured.

10. A garment hanger according to claim 1, further comprising:

an axle coupling said jaw end which is pivotable to said one of said first and second jaw members.

11. A garment hanger according to claim 1, further comprising:

a ball and socket coupling said jaw end which is pivotable to said one of said first and second jaw members.

12. A garment hanger according to claim 1, further comprising:

a pair of bumps and recesses coupling said jaw end which is pivotable to said one of said first and second jaw members.

13. A garment hanger, comprising:

a hanger body;

a hanging structure extending up from said body; and a first clamp extending down from said body, said first clamp having first and second jaw members, one of said first and second jaw members being pivotable relative to the other of said first and second jaw members, each of said first and second jaw members having a jaw end which is pivotable relative to the respective jaw member and locking means for locking said jaw ends in a selected position when said first clamp is in an open position.

14. A garment hanger according to claim 13, wherein:

said jaw ends each exhibit two selectable gripping surfaces.

15. A garment hanger according to claim 14, wherein:

one of said gripping surfaces on each jaw end is relatively smooth and the other of said gripping surfaces on each jaw end is relatively rough.

16. A garment hanger according to claim 14, further comprising:

a second clamp extending down from said body, said second clamp having third and fourth jaw members, each having a jaw end which is pivotable relative to the respective jaw member, said jaw ends of said third and fourth jaw members each exhibiting two selectable gripping surfaces.

17. A garment hanger according to claim 16, wherein said jaw ends of said third and fourth jaw members each exhibit one gripping surface which is relatively smooth and another gripping surface which is relatively rough.

18. A garment hanger according to claim 17, further comprising:

locking structures, one for locking each of said jaw ends in two positions, each position selecting one of said two selectable gripping surfaces.

19. A garment hanger according to claim 18, wherein:

said locking structures include a bump and two valleys.

20. A garment hanger according to claim 17, wherein:

said relatively rough gripping surface comprises a plurality of teeth.

21. A garment hanger according to claim 20, wherein:

said relatively smooth gripping surface is textured.

22. A garment hanger according to claim 17, wherein:

said relatively smooth gripping surface is textured.

23. A garment hanger according to claim 14, wherein:

each of said jaw ends is mounted on an axle.

24. A garment hanger according to claim 14, wherein:

each of said jaw ends is coupled to a respective jaw member by a ball and socket.

25. A garment hanger according to claim 14, wherein:

each of said jaw ends is coupled to a respective jaw member by a pair of bumps and recesses.

* * * * *